US006909856B2

(12) United States Patent
Crichton

(10) Patent No.: US 6,909,856 B2
(45) Date of Patent: Jun. 21, 2005

(54) FUNCTIONALITY SWITCHING FOR MICR PRINTING

(75) Inventor: John F. Crichton, Honeoye Falls, NY (US)

(73) Assignee: Eastman Kodak Company, Rochester, NY (US)

( * ) Notice: Subject to any disclaimer, the term of this patent is extended or adjusted under 35 U.S.C. 154(b) by 96 days.

(21) Appl. No.: 10/669,732

(22) Filed: Sep. 24, 2003

(65) Prior Publication Data

US 2004/0062558 A1 Apr. 1, 2004

Related U.S. Application Data

(60) Provisional application No. 60/415,221, filed on Oct. 1, 2002.

(51) Int. Cl.[7] ..... G03G 15/00

(52) U.S. Cl. ..... 399/12; 399/42

(58) Field of Search ..... 399/9, 12, 24, 399/25, 34, 38, 42, 107, 112

(56) References Cited

U.S. PATENT DOCUMENTS

| | | | | |
|---|---|---|---|---|
| 4,473,029 A | | 9/1984 | Fritz et al. | 118/657 |
| 5,289,242 A | * | 2/1994 | Christensen et al. | 399/12 |
| 5,956,544 A | | 9/1999 | Stern et al. | 399/73 |
| 6,011,935 A | * | 1/2000 | Matsuzaka et al. | 399/12 |
| 6,121,986 A | | 9/2000 | Regelsberger et al. | 347/151 |
| 2002/0115006 A1 | | 8/2002 | Jadwin et al. | 430/106.1 |

FOREIGN PATENT DOCUMENTS

| | | | | |
|---|---|---|---|---|
| JP | 6-35307 | * | 2/1994 | |
| WO | WO 02/10860 A1 | | 2/2002 | G03G/15/00 |
| WO | WO 02/14957 A1 | | 2/2002 | G03G/15/00 |

* cited by examiner

*Primary Examiner*—Hoan Tran
(74) *Attorney, Agent, or Firm*—Richard A. Romanchik

(57) ABSTRACT

An electrographic printing machine (10) operable in combination with an installed one of a plurality of developing, or toning, stations (38*a*, 38*b*), is disclosed. Each of the plurality of toning stations (38*a*, 38*b*) is associated with a toner type, with one of the toning stations (38*a*) associated with Magnetic Ink Character Recognition (MICR) toner. Each toning station (38*a*, 38*b*) has an indicator (50), for example a resistor, that can be interrogated or measured by the printing machine (10) when installed, so that the printing machine (10) is aware of the type of toner to be used. If a MICR toning station (38*a*) is installed, a set of process setpoints and parameters are used that optimize MICR printing; if a normal toning station (38*b*) is installed, a different set of process setpoints and parameters adapted for the normal toner is used. Also in response to detecting that the MICR toning station (38*a*) is installed, the printing machine (10) enables certain security functions, such as privilege-level control of MICR fonts and secure files, and also such as disabling features such as automatic reprinting.

19 Claims, 4 Drawing Sheets

FUNCTIONALITY SWITCHING FOR MICR PRINTING

CROSS-REFERENCE TO RELATED APPLICATIONS

This application claims priority to U.S. Provisional Application Ser. No. 60/415,221 titled FUNCTIONALITY SWITCHING FOR MICR PRINTING filed Oct. 1, 2002 and which is incorporated herein in it's entirety by reference.

FIELD OF THE INVENTION

The present invention electrographic printers, and more particularly to electrographic printing machines operable in combination with an installed one of a plurality of developing, or toning, stations.

BACKGROUND OF THE INVENTION

This invention is in the field of electrographic printing, and is more specifically directed to the electrographic printing of documents suitable for reading by Magnetic Ink Character Recognition (MICR) technology.

Electrographic printing has become the prevalent technology for modem computer-driven printing of text and images, on a wide variety of hard copy media. This technology is also referred to as electrographic marking, electrostatographic printing or marking, and electrophotographic printing or marking. Conventional electrographic printers are well suited for high resolution and high speed printing, with resolutions of 600 dpi (dots per inch) and higher becoming available even at modest prices. As will be described below, at these resolutions, modem electrographic printers and copiers are well-suited to be digitally controlled and driven, and are thus highly compatible with computer graphics and imaging.

A typical electrographic printer includes a primary image forming photoconductor, which may be a moving belt in large scale printers, or a rotating drum in smaller laser printers and photocopiers. The photoconductor is initially sensitized or conditioned by the application of a uniform electrostatic charge at a primary charging station in the printer. An exposure station forms an image on the sensitized photoconductor by selectively exposing it with light according to the image or text to be printed. The exposure station may be implemented as a laser, an array of light emitting diodes (LEDs), or a spatial light modulator. In modem electrographic printing, a computer typically drives the exposure station in a raster scan manner according to a bit map of the image to be printed. The exposing light discharges selected pixel locations of the photoconductor, so that the pattern of localized voltages across the photoconductor corresponds to the image to be printed.

At a developing or toning station in the typical electrographic printer, a developer roller or brush is biased to a bias voltage roughly at the primary charging voltage of the sensitized photoconductor prior to exposure. The biased developer roller or brush is loaded with toner charged to the bias voltage. As the exposed photoconductor passes the developing station, toner is attracted to the discharged pixel locations of the photoconductor. As a result, a pattern of toner corresponding to the image to be printed appears on the photoconductor.

The typical electrographic printer transfers the pattern of toner from the photoconductor to the printed medium (e.g., paper) at a transfer station. The transfer station charges the medium to an opposing voltage, so that the toner on the photoconductor is attracted to the medium, as the medium is placed in proximity to the photoconductor. Heat is then applied to the medium to fuse the transferred toner, and the medium is discharged and ejected from the printer. The photoconductor is then cleaned of any residual toner, and is prepared for the next image.

Magnetic Ink Character Recognition (MICR) technologies have been used for many years for the automated reading and sorting of checks and negotiable payment instruments, as well as for other documents in need of high speed reading and sorting. As well known in the art, MICR toner is a mixture of a fine metallic powder with polyester resin and powdered dye and MICR documents are printed with characters in a special font (e.g., the E13-B MICR font in the United States, and the CMC-7 MICR standard in some other countries). Typically, MICR characters are used to indicate the payor financial institution, payor account number, and instrument number, on the payment instrument. In addition to the special font, MICR characters are printed with special inks or toners that include magnetizable substances, such as iron oxide, that can be magnetized in the reading process. The magnetized MICR characters present a magnetic signal of adequate readable strength to the reading and sorting equipment, to facilitate automated routing and clearing functions in the presentation and payment of these instruments.

The relatively heavy loading of iron oxide in conventional MICR toner for electrographic MICR printing has been observed to adversely affect the image quality of the printed characters, however. It is difficult to achieve and maintain an adequate dispersion of the heavy iron oxide particles in the toner resin. In addition, the toning and fusing efficiencies of MICR toners are poorer than normal (i.e., non-MICR) toners, because of the magnetic loadings present in the MICR toner. Accordingly, the image quality provided by MICR toner is often poorer than those formed by normal toner, unless the printing machine makes significant adjustments in its printing process.

Many documents having MICR characters also include printed features and characters that are not MICR characters. This of course requires either two printing passes (one pass for MICR printing using MICR toners and another pass for the non-MICR printing using normal toners), or the printing of both the MICR and non-MICR features with MICR toners. In some installations, the MICR printing volume is sufficient that one electrographic printer is dedicated to the printing of the MICR characters on all documents, with other printers used to print the non-MICR features on those documents. In other installations, the MICR encoded volume is less than the capacity of one printer. Some conventional electrographic printing systems permit the swapping of toning stations, so that the operator can switch between MICR and normal toners, for printing MICR and non-MICR documents, respectively.

As noted above, MICR characters are used for the printing of sensitive information such as financial institution routing numbers, and account numbers. Unauthorized use of these numbers on payment documents can facilitate fraud and theft. As such, MICR printing is preferably carried out in reasonably secure environments, by trusted human operators.

It has been observed, in connection with this invention, that the differences between MICR toners and normal toners, particularly in the developing or toning process of electrographic printing, require different operational settings for optimal image formation using MICR toners from the operational settings for optimal image formation using normal toners. Accordingly, the operator ought to change the operational settings of the electrographic printer as he or she swaps toning stations to change between MICR and normal toners.

BRIEF SUMMARY OF THE INVENTION

It is therefore an object of this invention to provide an electrographic printer and method of operating the same that automatically changes settings according to the type of toner currently in use.

It is a further object of this invention to provide such a printer and method in which the developer settings are automatically changed according to the type of toner used.

It is a further object of this invention to provide such a printer and method in which the type of toner is automatically sensed upon change of the developer station.

It is a further object of this invention to provide such a printer and method in which security features are automatically enabled upon use of a certain toner type, such as MICR toner.

Other objects and advantages of this invention will be apparent to those of ordinary skill in the art having reference to the following specification together with its drawings.

The present invention may be implemented into an electrographic printer capable of accepting different types of toner. The printer senses the insertion of a developing station using a certain type of toner, such as MICR toner. Upon sensing the toner type, the printer sets its operational parameters to optimal settings for that toner. According to another aspect of the invention, the printer enables certain security settings upon insertion of a toner type, such as MICR toner, that is used for secure printing.

DETAILED DESCRIPTION OF THE INVENTION

The preferred embodiment of this invention will now be described in connection with an electrographic printer, by way of example, because this invention is contemplated to be particularly beneficial in such an application. It will be appreciated by those skilled in the art having reference to this specification that this invention can also be used in any type of electrographic system, of any size or capacity. As such, this description is provided by way of example only, and is not intended or contemplated to limit the true scope of the invention as claimed.

Figure 1:
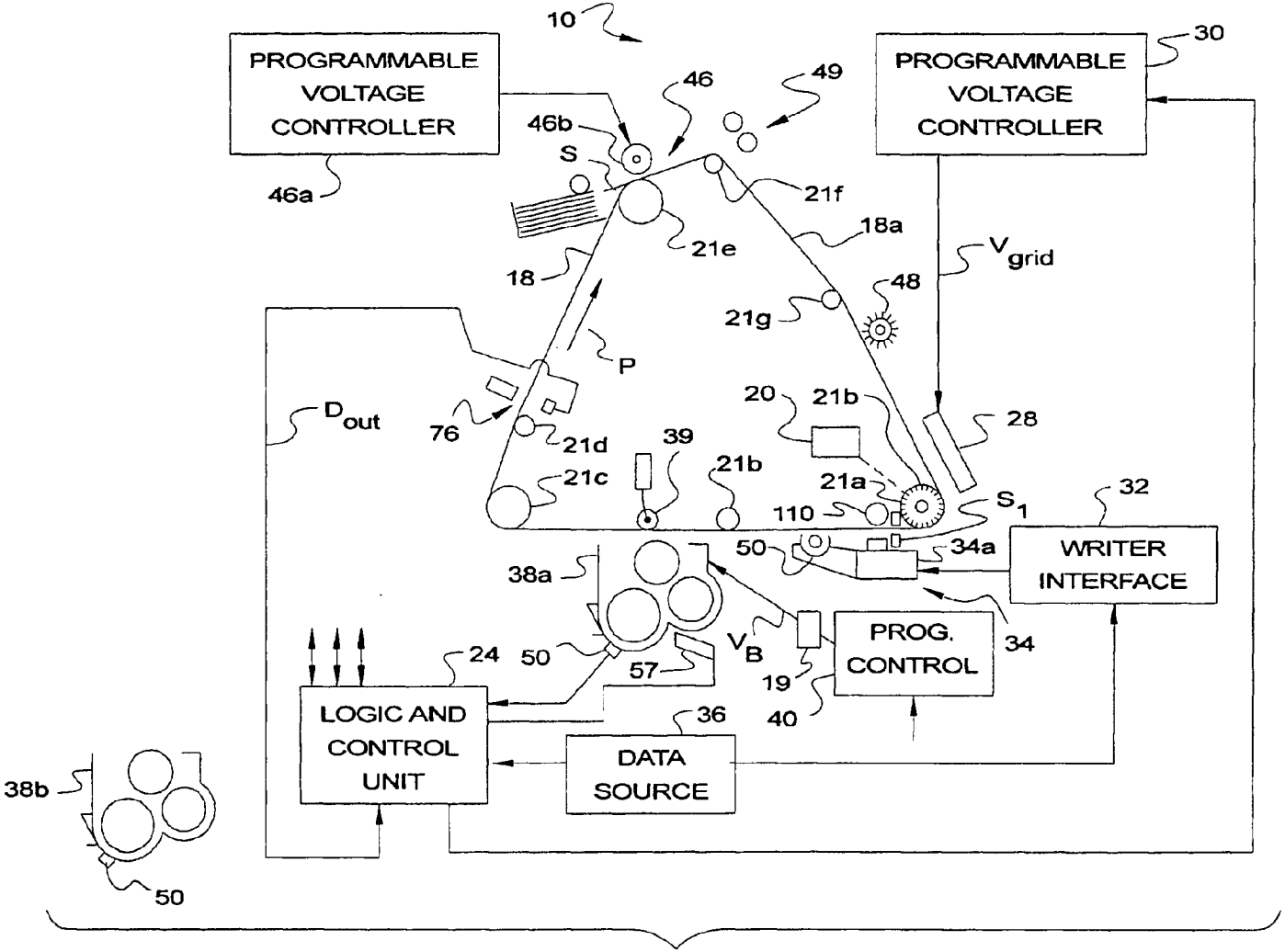
FIG. 1 is a schematic diagram of an electrographic marking, or reproduction machine, such as an electrographic printing machine, constructed according to a preferred embodiment of this invention.

Referring now to FIG. 1, printer machine 10 according to the preferred embodiments of the invention will now be described. The exemplary printing machine 10 is illustrated in a general schematic sense, to provide a general context for the preferred embodiments of the invention; it is contemplated that this invention will be applicable to a wide range of printing machines. An example of a preferred model of printing machine 10 into which the preferred embodiments of the invention can be implemented is the DIGIMASTER 9110 printer available from Heidelberg Americas, Inc.

In the example of electrographic printer machine 10 of FIG. 1, moving photoconductor 18, in the form of a belt, is entrained about a plurality of rollers or other supports 21*a* through 21*g*, one or more of which is driven by a motor to advance photoconductor 18. By way of example, roller 21*a* is illustrated as being driven by motor 20. Motor 20 preferably advances photoconductor 18 at a high speed, such as 15 inches per second or higher, in the direction indicated by arrow P, past a series of workstations of the printer machine 10. Alternatively, photoconductor 18 may be wrapped and secured about a single drum, rather than the multiple supports shown in FIG. 1.

Printer machine 10 includes logic and control unit (LCU) 24, preferably a digital computer or microprocessor operating according to a stored program, for sequentially actuating the workstations within printer machine 10 and effecting overall control of printer machine 10 and its various subsystems. LCU 24 is also programmed to provide closed-loop control of printer machine 10 in response to signals from various sensors and encoders. According to the preferred embodiments of the invention, one such sensor senses the identity of a toning, or development, station installed into printing machine 10, thus sensing the type of toner currently being used. Also, the identity of toning will effect the particular start up cycle which is initiated. In response to the identity of the toning station, printing machine 10 selects a set of process control parameters including fuser temperature, toning station bias, densitometer aim, transfer current, fuser heater cleaning web advance rate, and other process setpoints. The sensed identity of the toning station, and thus the toner, also controls whether certain security features are enabled, according to the preferred embodiment of the invention; examples of these security features include printing permission or authority levels, print settings such as controlled reprints, access to certain fonts, and the like. These operations will be described in further detail below.

Referring back to FIG. 1, primary charging station 28 in printer machine 10 sensitizes photoconductor 18 by applying a uniform electrostatic corona charge, from high-voltage charging wires at a predetermined primary voltage, over an image frame area of the surface 18*a* of photoconductor 18. Preferably, photoconductor 18 is sufficiently long to have multiple image frames over its length, with interframe spaces between these image frames that are used for process control as described below. The primary charging voltage output by charging station 28 is regulated by programmable voltage controller 30, which is in turn controlled by LCU 24. This primary voltage is preferably adjusted by controlling the electrical potential of a grid, which controls movement of the corona charge as is well known. Other forms of chargers, including brush or roller chargers, may also be used.

Exposure station 34 in printer machine 10 projects light from writer 34*a* to photoconductor 18. This light selectively dissipates the electrostatic charge on photoconductive photoconductor 18 to form a latent electrostatic image of the document to be copied or printed. Writer 34*a* is preferably constructed as an array of light emitting diodes (LEDs), or alternatively as another light source such as a laser or spatial light modulator. In any case, writer 34*a* exposes individual picture elements (pixels) of photoconductor 18 with light at a regulated intensity and exposure. According to this embodiment of the invention, image data to be printed is provided to writer 34*a* by data source 36, which is contemplated to be a computer or microcontroller. The exposed image is stored as a bit map in the memory of data source 36, or is received by data source 36 over a data network. Signals from data source 36, in combination with control signals from LCU 24 generated according to this invention, are provided to writer interface 32, to apply the pixel exposure pattern and also exposure correction parameters.

After exposure, the image frame of photoconductor 18 bearing the latent charge images travels to an installed one of multiple toning stations 38*a*, 38*b*. According to the preferred embodiment of the invention, toning stations 38*a*, 38*b* are modular, so that each can be easily installed into and removed from printing machine 10 by a human operator. The multiple modular toning stations 38*a*, 38*b* each contain a different type of toner, according to this embodiment of the invention, so that the appropriate toner can be selected and installed for particular printing jobs simply by selecting and installing the corresponding toner station 38*a*, 38*b*.

According to this preferred embodiment of the invention, toning station 38*a* contains Magnetic Ink Character Recognition (MICR) toner, as used for the printing of MICR encoded characters, such as bank routing numbers and account numbers on checks. Other documents that are commonly printed with at least some MICR encoded characters include airline tickets, vouchers, return receipts, and the like. Toning station 38*b* (available but not installed in the configuration shown in FIG. 1) contains conventional toner, and is for conventional black-and-white printing by electrographic printer 10. In general, the toner in each of the multiple toning stations 38*a*, 38*b* consists of a two component developer mix which comprises a dry mixture of toner and carrier particles. The carrier particles are typically high coercivity (hard magnetic) ferrite particles, which are generally quite large (e.g., on the order of 30$\mu$ in volume-weighted diameter), while the dry toner particles are substantially smaller (e.g., on the order of 6$\mu$ to 15$\mu$ in volume-weighted diameter). The specific composition of the developer mix will depend upon the desired characteristics for the particular printing job, as will be described in further detail below.

MICR toner, as contained in toning station 38*a*, conventionally includes a heavy loading of iron oxide or another magnetic material, in its toner particles. When printed on a document, preferably in a MICR font, this magnetic material provides a sufficiently strong magnetic signal to a conventional MICR reader that the characters printed using the MICR toner can be magnetically read. In addition, as well known in the art, conventional MICR toner also contains a sufficient amount of carbon black or another dye as to be visible when printed on conventional paper or other media; in addition, the MICR font also resembles the alphanumeric characters sufficiently that MICR encoded text is human-readable. A preferred composition of a MICR toner is described in copending application U.S. Ser. No. 09/747,764, filed Dec. 26, 2000, published on Aug. 22, 2002 as U.S. Patent Application Publication No. US 2002/0115006 A1, commonly assigned herewith and incorporated herein by this reference.

Conventional toner, as contained in toning station 38*b*, may be of a conventional type of toner or developer mixture as appropriate for non-coded printing, depending upon the particular printing task that is to be carried out with toning station 38*b* installed in printing machine 10. The dye contained within this conventional toner will, of course, correspond to the desired color of printed output.

Figure 2:
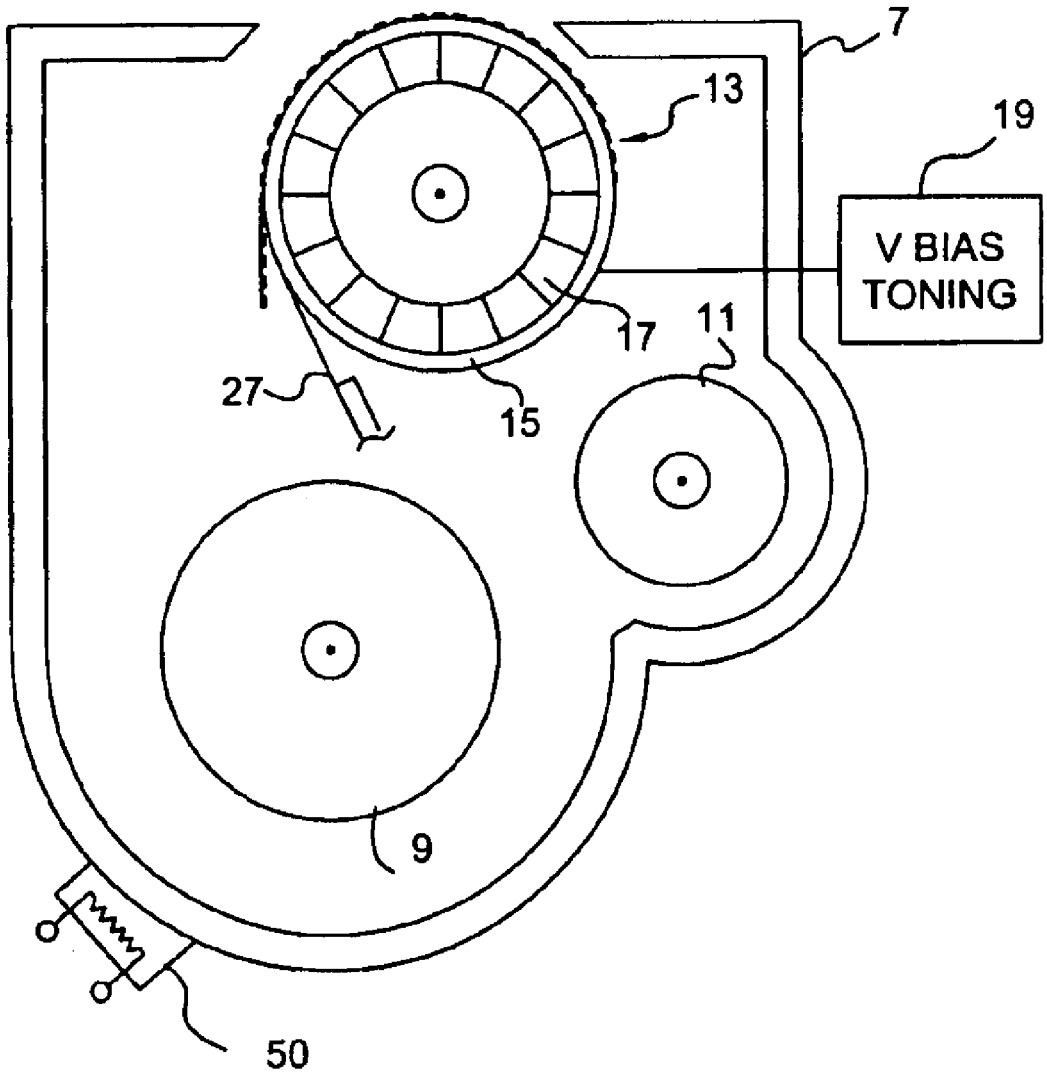
FIG. 2 is a cross-sectional schematic diagram of a toning station used in the printing machine of FIG. 1, and constructed according to the preferred embodiment of the invention.

The generalized construction of toning station 38*a* according to an exemplary implementation of the preferred embodiments of the invention, will now be described relative to FIG. 2. It is contemplated that the other toning stations suitable for use with printing machine 10, such as toning station 38*b*, will be similarly constructed as toning station 38*a*, particularly in form factor and in its interfaces for coupling to printing machine 10. As shown in FIG. 2, toning station 38*a* is constructed within housing 7. Mixer 9 mixes the carrier and toner particles, and feed roller 11 moves the developer mixture toward applicator roller 13. Applicator roller 13, according to the preferred embodiment of the invention, has non-magnetic cylindrical shell or sleeve 15 surrounding rotatable magnetic core 17. Motors (not shown) are provided to rotate mixers 9, feed roller 11, and rotatable magnetic core 17. Shive blade 27 is disposed adjacent to applicator roller 13, to clean the large carrier particles from its surface. As described in U.S. Pat. No. 4,473,029, incorporated herein by this reference, the relative rotation of the core and shell moves the developer mixture through a development zone in the presence of an electrical field. As known in the art, applicator 13 is biased by variable power supply 19 to DC potential $V_B$, within programmable controller 40 (FIG. 1), in response to control signals from LCU 24, to control the toning or development process.

This construction of toning station 38 is described in a somewhat generic sense, as including a mixer, a feeder (e.g., a feed roller), and a core-and-shell applicator. Various alternative constructions of toning station 38 will be apparent to those skilled in the art having reference to this specification. One example of such an alternative construction of toning station 38 includes a magnetic brush in juxtaposition to, but spaced from, the travel path of photoconductor 18. Magnetic brush toning, or development, stations are well known in the art, and are preferred in many applications; alternatively, other known types of toning stations or devices may be used.

Each of toning stations 38*a*, 38*b* include an indicator 50, for communicating the identity of its toning station 38*a*, 38*b* to LCU 24, when installed in printing machine 10. According to an exemplary embodiment of the preferred embodiment of the invention, as shown in FIG. 2, indicator 50 is a resistor having a selected value that distinguishes its toning station 38 from the other available toning stations 38, connected to external terminals that mate with printing machine 10 when toning station 38 is installed. Alternatively, other types of identifiers may be used as indicator 50, including an externally readable digital code (for example in a read-only-memory), an optical indicator such as a bar code, or a mechanical indicator such as a code of tabs or openings. It is contemplated that other types of identifiers will be readily apparent to those skilled in the art having reference to this specification. The detection of the installed one of toning stations 38*a*, 38*b*, and the subsequent operation of printing machine 10 in response to the result of that detection, according to the preferred embodiment of the invention, will be described in further detail below.

In operation, referring back to FIG. 1, roller 39 applies pressure to bias photoconductor 18 toward applicator roller 13 of toning station 38*a*. The charged toner particles at applicator roller 13 are selectively attracted to the latent image patterns defined by the exposed locations of photoconductor 18 and adhere to these exposed locations of photoconductor 18, thus developing the electrostatic images onto photoconductor 18 according to the exposure pattern. The carrier material remains at toning station 38. As the toner particles are depleted from the developer mixture as images are developed, additional toner is periodically introduced by a conventional toner auger (not shown), for mixture with the carrier particles to maintain a uniform amount of development mixture. This development mixture is controlled in accordance with various development control processes, which are well known in the art.

Transfer station 46 in printing machine 10, as is well known, moves receiver sheet S into engagement with photoconductor 18, in registration with the developed image, to transfer this developed image to receiver sheet S. Receiver sheet S may be plain or coated paper, plastic, or another medium capable of being handled by printer machine 10. Typically, transfer station 46 includes a charging device for electrostatically biasing movement of the toner particles from photoconductor 18 to receiver sheet S. In this example, the biasing device is roller 46*b*, which engages the back of sheet S and which is connected to programmable voltage controller 46*a* that operates in a constant current mode during transfer. Alternatively, an intermediate member may have the image transferred to it and the image may then be transferred to receiver sheet S. After transfer of the toner image, sheet S is detacked from photoconductor 18 and transported to fuser station 49 where the image is fixed onto sheet S, typically by the application of heat. Alternatively, the image may be fixed to sheet S at the time of transfer.

Cleaning station 48, such as a brush, blade, or web as is well known, is also located behind transfer station 46, and removes residual toner from the image frame of photoconductor 18. A pre-clean charger (not shown) may be located before or at cleaning station 48 to assist in this cleaning. After cleaning, the portion of photoconductor 18 corresponding to the printed image frame is then ready for recharging and re-exposure. Of course, other image frames of photoconductor 18 are simultaneously located at the various workstations of printing machine 10, so that the printing process is carried out in a substantially continuous manner.

As mentioned above, LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such as from as a human user or a network control. The output data and control signals from LCU 24 are applied directly or through storage latches to suitable output drivers and in turn to the appropriate subsystems within printing machine 10.

Process control strategies generally utilize various sensors to provide real-time closed-loop control of the electrographic process so that printing machine 10 generates "constant" image quality output, from the user's perspective. One of such sensors may be densitometer 76, which monitors test patches that are exposed and developed in non-image areas of photoconductive photoconductor 18 under the control of LCU 24, as described in U.S. Pat. No. 6,121,986. Densitometer 76 may include a light emitter, such as infrared or visible light LED, and a light collector such as a photodiode. A preferred construction of densitometer 76 is described in International Publication Number WO 02/14957 A1, commonly assigned herewith and incorporated herein by this reference. Depending on the arrangement of densitometer 76, light from the light emitter either shines through the belt or is reflected by the belt onto the light collector, and the intensity is converted to an electrical signal representative of the reflected or transmitted light. As described in U.S. Pat. No. 6,121,986 and in International Publication WO 02/10860, the toned test patches are preferably formed to varying toner density levels, to provide improved accuracy in the process control of printing machine 10. Because the toned test patches are formed in the interframe area of photoconductor 18, this process control can be carried out in real time without reducing the printed output throughput.

Another sensor useful for monitoring process parameters in printer machine 10 is electrometer probe 50, mounted downstream of the corona charging station 28 relative to direction P of the movement of photoconductor 18. An example of an electrometer is described in U.S. Pat. No. 5,956,544. Electrometer probe 50 provides a measurement of the reading of the actual voltage at photoconductor 18, for use in calculating the efficiency of primary charger 28, as described in U.S. Pat. No. 6,121,986.

Certain process control parameters have been observed, in connection with this invention, to be dependent upon the type of toner used. More specifically, it has been observed that MICR toners and conventional normal toners require different process control parameter setpoints for optimal printing. One such setting is the adjustment of primary charging voltage and exposure according to the aim densitometer 76 output voltage, which preferably differs between MICR and other toners. In addition, the fusing temperature applied by fuser station 49 is preferably set to different temperatures for MICR toners (e.g., on the order of 190° C.) than for normal toners (e.g., on the order of 180° C.). Other process parameters that preferably differ for MICR and normal toners include fuser heater cleaning web advance rate, the transfer current applied by transfer station 46, and the toning station bias voltage VB applied by variable power supply 19 under the control of programmable controller 40. It is contemplated that those skilled in the art having reference to this specification will recognize other process parameters that have different optimal settings for use in connection with different types of toners, including MICR toners.

As mentioned above, MICR encoded characters are often used for financial instruments, or for documents that are associated with significant monetary value (e.g., airline tickets, vouchers, etc.). The financial value of these types of documents often make it prudent to incorporate security functions for the printing of MICR encoded documents. These security functions of course are often not necessary for documents that are not MICR encoded, or for the printing of the non-MICR encoded portions of documents that will eventually be MICR encoded.

Figure 3:
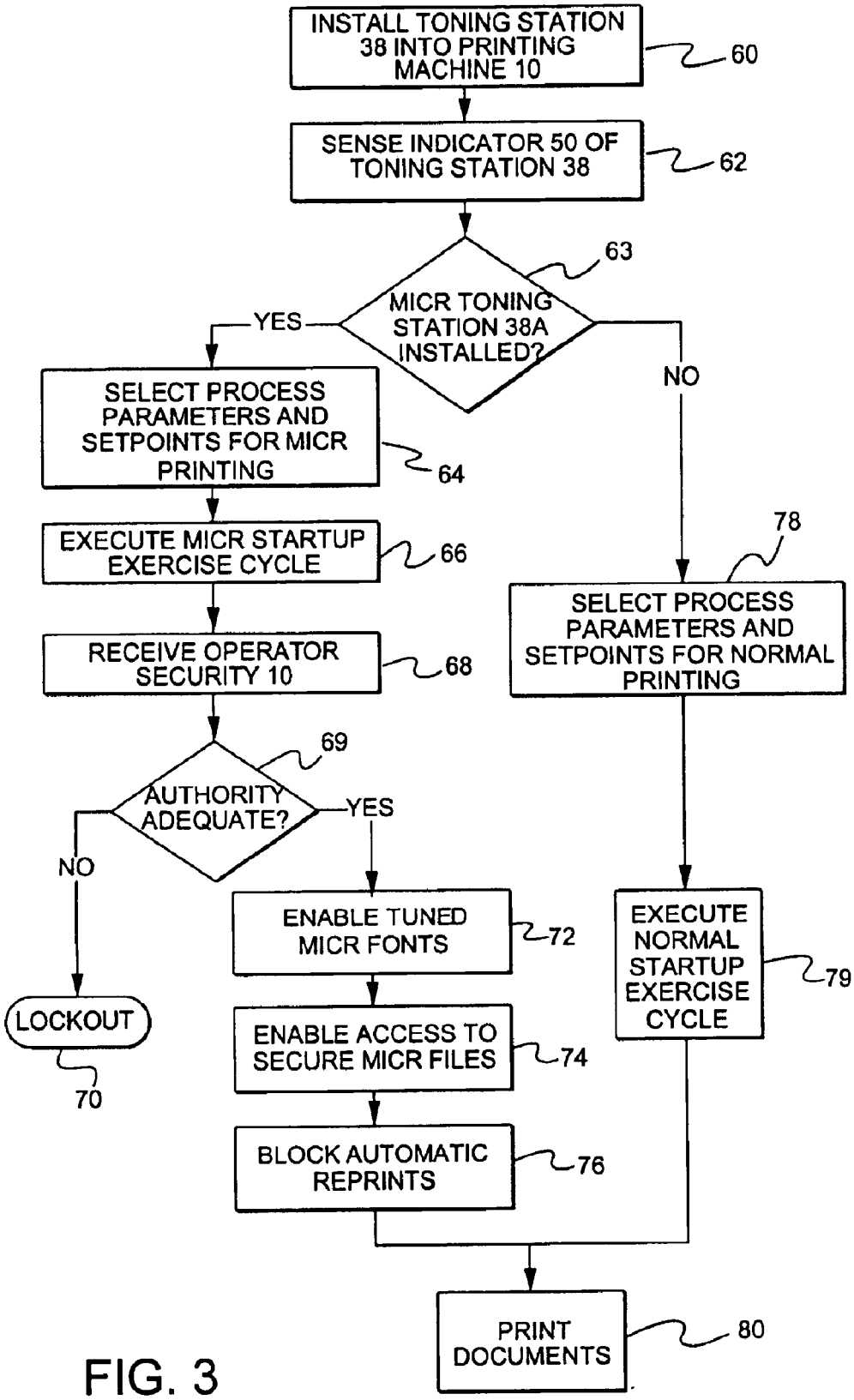
FIG. 3 is a flow chart illustrating the operation of the printing machine of FIG. 1, according to the preferred embodiment of the invention.

Referring now to FIG. 3, the operation of printing machine 10 according to the preferred embodiment of the invention will now be described in detail. Of course, alternatives to the specific operations and steps of this exemplary process will be apparent to those skilled in the art having reference to this specification, it being understood that such alternatives are within the scope of this invention as claimed. In addition, while this process will be described in connection with two available toning stations 38*a*, 38*b*, with toning station 38*a* associated with MICR toner, it is of course contemplated that more than two toning stations 38 may be available, each with their own associated optimal printing and process conditions; it is further contemplated that these toning stations 38 may not necessarily include a toning station 38*a* having MICR toner. This description is based on toning station 38*a* having such MICR toner, however, because it is contemplated that this invention is particularly advantageous when applied to MICR encoded printing.

In process 60, toning station 38 is installed into printing machine 10, in advance of the printing of documents or other output using the toner in that toning station. As noted above, the available toning stations 38*a*, 38*b*, etc. are constructed to have a common form factor and interface capability, so as to be interchangeable within printing machine 10. Process 60 may also be initiated upon the power-up of printing machine 10, without the installation of a different toning station 38.

In process 62, printing machine 10 senses the identity of the installed toning station 38, by sensing indicator 50 associated with that installed toning station. According to an exemplary implementation of the preferred embodiment of the invention, sensing process 62 is carried out by LCU 24 measuring a voltage drop across a resistor value in indicator 50, as will now be described relative to FIG. 4.

Figure 4:
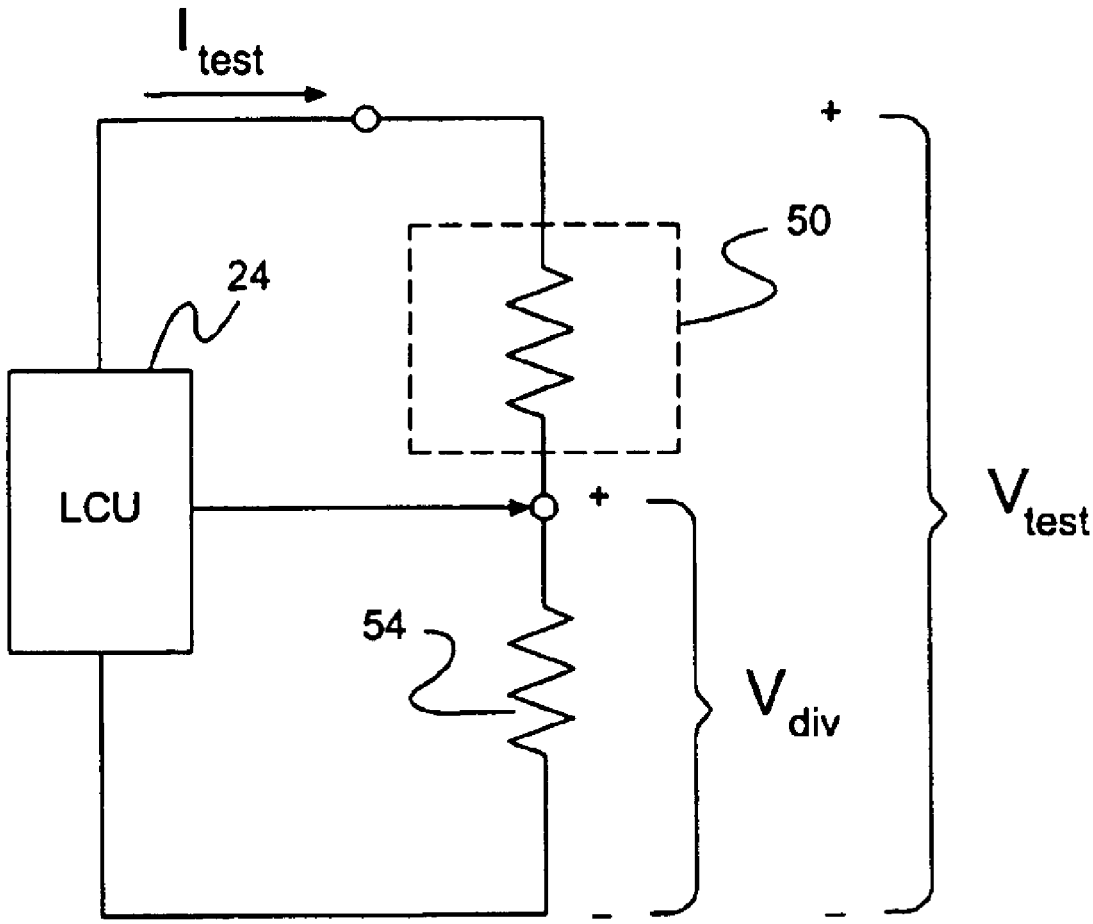
FIG. 4 is an electrical diagram, in schematic form, illustrating the sensing of a toning station indicator in the process of FIG. 3, according to the preferred embodiment of the invention.

As mentioned above, according to an exemplary embodiment of the invention, indicator 50 is constructed as a resistor, with external terminals that interface with printing machine 10. FIG. 4 schematically illustrates the operation of LCU 24 in measuring the voltage across a resistor network including indicator 50. In this implementation, LCU 24 is in electrical connection with the external terminals of indicator 50, such that indicator 50 is placed in series with test resistor 54 (either in LCU 24 or external thereto). Indicator 50 thus becomes part of a voltage divider, measurable by LCU 24. In sensing process 62, LCU 24 applies a test voltage $V_{test}$ across the voltage divider, between one terminal of indicator 50 and test resistor 54, resulting in a test current $I_{test}$. LCU 24 then measures the voltage $V_{div}$ at a second terminal of indicator 50, which is at the point between indicator 50 and test resistor 54. The voltage $V_{div}$ will of course depend on the resistance value of indicator 50 (test resistor 54 being constant for all toning stations 38). A comparison of voltage $V_{div}$ against preselected voltage ranges for identifying the various toning stations 38 thus indicates the identity of the installed toning station 38 as the result of process 62.

Alternatively, LCU 24 could sense the resistance value of indicator 50, by measuring current $I_{test}$ and dividing it into applied voltage $V_{test}$. Further in the alternative, the entire voltage divider (i.e., both the resistor of indicator 50 and also resistor 54) could be incorporated within indicator 50, so that indicator 50 would present a three-terminal interface to LCU 24 (two bias terminals, and the measurement terminal between the two resistors). It is contemplated that these and other alternative realizations of a passive electrical indicator may be used to implement indicator 50 and its sensing by LCU 24.

As mentioned above, alternative identification techniques are also contemplated. One example of such an alternative techniques include the incorporation of a digital identifier 50 within toning station 38, such as by way of an addressable memory location. Mechanical indicators, such as the placement of movable lugs into selected locations of an array of holes in toning station 38, may also be used. Optical indicators may also be utilized according to this invention. It is contemplated that those skilled in the art having reference to this specification will readily recognize other alternative identification schemes, each of which are contemplated to be within the scope of this invention. It is contemplated, however, that the simple voltage divider technique described relative to FIG. 4 is particularly advantageous because of its simplicity and its compatibility with conventional logic units serving as LCU 24.

In this preferred embodiment of the invention, LCU 24 executes decision 63 based on the results of sensing process 62, to determine whether MICR toning station 38*a* was installed in printing machine 10. If not (decision 63 is NO), printing machine 10 selects a set of process parameter setpoints associated with normal toner printing, in process 78. A startup exercise cycle for printing machine 10, for normal printing, is then executed in process 79, carrying out an auto set-up routine, for example as described in U.S. Pat. No. 6,121,986, incorporated herein by this reference. These functions include adding toner, warming and charging the developer mix in toning station 38*b*, retrieving from memory the set of electrographic printing setpoint values and operating parameters selected in process 78, recalculating additional electrographic printing setpoints as appropriate to begin printing. Other functions include the synchronization of system timing is synchronized, measurement of bare film densitometer readings for toner density process control as described in International Publication Number WO 02/14957 A1, incorporated herein by this reference, and the derivation of bias voltages for primary charging station 28, developing station 38*b*, and exposure station 34. The electrographic printing setpoints are then adjusted for the current ambient conditions by way of the exposure and development of test toner patches on photoconductor 18. Printing machine 10 then begins the printing of documents in process 80, preferably under real-time process control, for example in the manner described in U.S. Pat. No. 6,121,986.

On the other hand, if LCU 24 determines that MICR toning station 38*a* is installed in printing machine 10 (decision 63 is YES), LCU 24 carries out a series of processes to enable, set up, and carry out MICR printing by printing machine 10. In process 64, LCU 24 selects a set of process parameters and setpoints for printing using the MICR toner in toning station 38*a*. As mentioned above, these parameters and setpoints include the aim of onboard densitometer 76, the fusing temperature applied by fuser station 49, the fuser heater cleaning web advance rate, the transfer current applied by transfer station 46, and the toning station bias voltage VB applied by variable power supply 19 under the control of programmable controller 40. In process 66, LCU 24 then executes the startup exercise cycle of printing machine 10 for MICR printing. As discussed above for normal printing, this startup routine includes an auto set-up routine, for example as described in U.S. Pat. No. 6,121,986; adding toner; warming and charging the developer mix in toning station 38*a*; retrieving the set of electrographic printing setpoint values and operating parameters selected in process 64; recalculating additional electrographic printing setpoints as appropriate to begin printing; synchronizing system timing; measuring bare film densitometer readings for toner density process control as described in International Publication Number WO 02/14957 A1; deriving bias voltages for primary charging station 28, developing station 38*b*, and exposure station 34; and adjusting the electrographic printing setpoints for the current ambient conditions via test toner patches.

According to this embodiment of the invention, beginning with process 68, LCU 24 carries out a series of security functions that are suitable for MICR printing. In process 68, LCU 24 receives an operator security ID from the human operator, for example by the operator entering a password or identifier at a keypad of printing machine, or by printing machine 10 reading a magnetic or optical identifier from the operator's badge. In decision 69, LCU 24 determines whether the identified operator has sufficient authority to perform MICR printing, for example by matching the operator ID to a look-up table of assigned authority levels. If not (decision 69 is NO), printing machine 10 is locked out in process 70, until a non-MICR toning station 38*b* is installed or until intervention by a supervisor or superuser of printing machine 10.

If the operator is identified as having adequate authority for MICR printing (decision 69 is YES), the appropriate permissions are then granted by LCU 24 to this operator. According to this embodiment of the invention, tuned MICR fonts (e.g., the E13-B MICR font in the United States, and the CMC-7 MICR standard in some other countries) are enabled for use in process 72, and printing machine 10 enables access to secure MICR files for printing, in process 74. Other security functions may also be enabled at this time. In this example, automatic reprints of pages are blocked in process 76. It is contemplated that those skilled in the art having reference to this specification will readily recognize that other security functions and permissions, as well as the implementation of a range of authority or permission levels, may similarly be added or substituted for those described in this exemplary implementation of the preferred embodiment of this invention.

Following the startup exercise cycle (process 66) and the enabling and setting of the appropriate security functions (processes 72, 74, 76), printing machine 10 then begins the printing of documents in process 80. As in the normal toner case, the printing of process 80 is preferably carried out under real-time process control, for example in the manner described in U.S. Pat. No. 6,121,986, but of course with the settings corresponding to those for MICR printing.

The printing and setup of printing machine 10 continues until the printer is turned off, or until a different toning station 38 is installed. Following each of these events, the process of FIG. 3 will again be carried out to sense the identity of the installed toning station 38, and to control printing machine 10 accordingly.

This invention provides several important benefits to electrographic printing. By sensing the identity of the installed toning system, the electrographic printer is able to automatically select its operating parameters and functionality, without requiring a human operator to manually carry out an involved set up process. This automatic sensing and control is especially important for electrographic printing machines capable of use with different types of toners that have significant differences in their optimal printing parameters. As a result of this invention, optimized printed output using any one of a number of toner types can be obtained, with a minimal amount of human intervention. In addition, the use of toner types, such as MICR toner, can be minimized according to this invention, because the automated setting of the printing machine facilitates the switching of toner types for different printing jobs. In addition, this invention enables the use of automated security functions for toning stations used for secure or financially sensitive documents, such as MICR toner for financial documents.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A method of operating an electrographic printing machine, comprising the steps of:

installing one of a plurality of toning stations into the printing machine, each of the plurality of toning stations associated with a toner type, and having an indicator corresponding to the toner type;

sensing the indicator of the installed one of the plurality of toning stations to determine the toner type of the installed one of the plurality of toning stations;

responsive to the sensing step determining that the installed one of the plurality of toning stations corresponds to toner of a first type, selecting a set of process setpoints associated with the toner of the first type; and operating the printing machine to electrographically print images using the selected set of process setpoints and the installed one of the toning stations.

2. The method of claim 1, wherein the indicator comprises a resistor of a selected value;

and wherein the sensing step comprises:

applying an electrical input to the indicator;

measuring an electrical signal from the indicator responsive to the applying step; and determining the toner type by comparing the measured electrical signal to preselected values.

3. The method of claim 1, wherein the first toner type corresponds to Magnetic Ink Character Recognition (MICR) toner.

4. The method of claim 3, wherein the selecting step comprises selecting a set of process setpoints adapted for electrographic printing with MICR toner.

5. The method of claim 4, further comprising:

after the selecting step, executing a startup exercise cycle for the printing machine.

6. The method of claim 3, further comprising:

responsive to the sensing step determining that the installed one of the plurality of toning stations corresponds to toner of the first type, enabling at least one security function of the printing machine.

7. The method of claim 6, wherein the at least one security function comprises:

receiving an operator identifier indicative of an authority level associated with the operator; and responsive to the received operator identifier indicating an authority level above a threshold, enabling the step of operating the printing machine to electrographically print images.

8. The method of claim 7, wherein the enabling step comprises enabling access to at least one MICR font.

9. The method of claim 7, wherein the enabling step comprises enabling access to at least one secure file.

10. The method of claim 7, further comprising:

responsive to the received operator identifier indicating an authority level below the threshold, disabling the step of operating the printing machine to electrographically print images.

11. The method of claim 6, further comprising:

responsive to the sensing step determining that the installed one of the plurality of toning stations corresponds to toner of the first type, disabling at least one printing function of the printing machine.

12. The method of claim 11, wherein the disabled at least one printing function comprises automatic reprinting.

13. The method of claim 3, wherein a second toner type corresponds to a normal printing toner;

and further comprising:

responsive to the sensing step determining that the installed one of the plurality of toning stations corresponds to toner of the second toner type, selecting a set of process setpoints adapted for electrographic printing with the normal printing toner.

14. An electrographic printing machine, comprising:

a photoconductor;

a primary charging station for charging a surface of the photoconductor;

an exposure station for exposing selected pixel locations of the surface of the photoconductor;

a transfer station for transferring toner from the surface of the photoconductor to a medium;

at least one motor for advancing locations of the surface of the photoconductor among the primary charging station, exposure station, developing station, and transfer station; and a plurality of toning stations for applying toner to the exposed selected pixel locations of the surface of the photoconductor, each of the plurality of toning stations associated with toner of a specific type, and each of the plurality of toning stations having an indicator indicating the associated toner type for the toning station; and logic and control circuitry, for sensing the indicator of an installed one of the plurality of toning stations to determine the toner type of the installed toning station, and for controlling the operation of the printing machine responsive to the determined toner type.

15. The printing machine of claim 14, wherein one of the plurality of toning stations is associated with Magnetic Ink Character Recognition (MICR) toner.

16. The printing machine of claim 15, wherein the logic and control circuitry is also for selecting a set of process setpoints adapted for use with MICR toner responsive to determining that the toner type of the installed toning station is MICR toner, and controls the operation of the printing machine responsive to the selected set of process setpoints.

17. The printing machine of claim 15, wherein the logic and control circuitry is also for enabling at least one security function responsive to determining that the toner type of the installed toning station is MICR toner.

18. The printing machine of claim 17, wherein the logic and control circuitry enables at least one security function by enabling access to a MICR font responsive to receiving an operator identifier of a suitable authority level.

19. The printing machine of claim 17, wherein the logic and control circuitry is for preventing automatic reprints responsive to determining that the toner type of the installed toning station is MICR toner.

* * * * *